US007511224B1

(12) United States Patent
Kossak

(10) Patent No.: US 7,511,224 B1
(45) Date of Patent: Mar. 31, 2009

(54) COMPRESSION CONNECTOR WITH TAP PORT CONFIGURED TO ENGAGE MULTIPLE SIZED TAP WIRES IN A SINGLE TAP PORT

(75) Inventor: Robert W. Kossak, Lemont, IL (US)

(73) Assignee: Panduit Corp., Tinley Park, IL (US)

( * ) Notice: Subject to any disclaimer, the term of this patent is extended or adjusted under 35 U.S.C. 154(b) by 0 days.

(21) Appl. No.: 12/045,834

(22) Filed: Mar. 11, 2008

(51) Int. Cl.
*H01R 4/00* (2006.01)

(52) U.S. Cl. ..... 174/84 R; 174/84 C

(58) Field of Classification Search ..... 174/74 R, 174/71 R, 84 C, 94 R, 84 R; 439/98, 877, 439/882
See application file for complete search history.

(56) References Cited

U.S. PATENT DOCUMENTS

| | | | | |
|---|---|---|---|---|
| 5,036,164 | A | 7/1991 | Schrader et al. | |
| 5,103,068 | A | 4/1992 | Schrader | |
| 5,162,615 | A | 11/1992 | Schrader et al. | |
| 5,200,576 | A | 4/1993 | Schrader et al. | |
| 5,396,033 | A | 3/1995 | Piriz et al. | |
| 5,552,564 | A | 9/1996 | Schrader et al. | |
| 5,635,676 | A | 6/1997 | Piriz | |
| 5,898,131 | A | 4/1999 | Chadbourne et al. | |
| 6,452,103 | B1 * | 9/2002 | Piriz et al. | 174/84 C |
| 6,486,403 | B1 | 11/2002 | Connor | |
| 6,525,270 | B1 | 2/2003 | Connor et al. | |
| 6,538,204 | B2 | 3/2003 | Connor | |
| 6,552,271 | B2 | 4/2003 | Connor et al. | |
| 6,747,211 | B2 | 6/2004 | Connor et al. | |
| 6,818,830 | B2 * | 11/2004 | O'Grady et al. | 174/84 C |
| 6,846,989 | B2 * | 1/2005 | Sokol et al. | 174/84 C |
| 7,026,552 | B2 * | 4/2006 | Sokol et al. | 174/84 C |
| 7,053,307 | B2 * | 5/2006 | Kossak et al. | 174/84 R |
| 7,121,001 | B2 * | 10/2006 | O'Grady et al. | 29/871 |
| 7,183,489 | B2 | 2/2007 | Kossak et al. | |
| 2005/0139374 | A1 * | 6/2005 | Sokol et al. | 174/84 C |
| 2007/0004289 | A1 | 1/2007 | Hoxha et al. | |

* cited by examiner

*Primary Examiner*—William H Mayo, III
(74) *Attorney, Agent, or Firm*—Robert A. McCann; Christopher S. Clancy

(57) ABSTRACT

A compression connector for crimping and securing a tap wire of various sizes within a range of tap wire sizes to a main line wire. The compression connector has a body portion including a first hook and a first ramp extending from the compression connector body part. The space between the hook and the ramp comprises a first opening for insertion of a main line wire into contact with the hook and ramp prior to crimping. The body portion also includes a second hook and a second ramp forming a second opening defining an entrance to a tap wire port. The body portion defining the second opening includes nest portions adapted to receive and accommodate different sizes of tap wires prior to crimping, and to hold the tap wires in place during crimping. Each nest portion is in communication with the second opening that forms a single entrance to the tap wire port.

10 Claims, 8 Drawing Sheets

COMPRESSION CONNECTOR WITH TAP PORT CONFIGURED TO ENGAGE MULTIPLE SIZED TAP WIRES IN A SINGLE TAP PORT

BACKGROUND OF THE INVENTION

The present invention is directed to a compression connector and, more particularly, to a compression connector having a single tap wire port configuration that can accommodate several sizes of tap wires in one of a plurality of nests, each nest communicating with the single tap wire port formed in the connector.

Examples of compression connectors can be found in the following U.S. Pat. Nos. 5,036,164; 5,200,576; 6,452,103; 6,486,403; 6,846,989; 7,026,552; 7,053,307 and 7,183,489. However, none of these compression connectors have a body portion with a single opening forming a tap wire input port entrance, and a plurality of nests formed in the body portion, with each nest communicating with the single opening and adapted to receive the tap wire depending on the size of the tap wire. Furthermore, the previously disclosed compression connectors adapted to connect tap wires of varying sizes to a main line wire are relatively difficult to manufacture.

SUMMARY OF THE INVENTION

It would be desirable to provide a compression connector having increased wire pullout resistance strength for a wide range of tap wire sizes.

It would also be desirable to provide a compression connector that, when crimped between symmetrical crimping dies, provides high wire securing forces.

It would further be desirable to provide a compression connector having a single tap wire port entrance providing ease of access for tap wires of varying sizes.

It would further be desirable to provide a compression connector having the above advantages and is also easy to manufacture.

It would also be desirable to provide a compression connector having a tap wire port configuration whereby any size of tap wire in a given size range may be crimped to varying locations along the tap wire port area, and at a sufficient amount of force to firmly hold the tap wire in the tap wire port.

A compression connector for securing at least one tap wire to a main line wire is disclosed. The compression connector has a body portion with a first hook and first ramp extending from the body portion to form a first opening defining an entrance to a main wire port. The body portion also includes a second hook and a second ramp extending from the body portion to form a second opening defining an entrance to a tap wire port. At least one nest is formed in the tap wire port, each nest sized to receive a tap wire of varying size to facilitate crimping of the tap wire with a high degree of force. In an embodiment, the tap wire port is configured to receive and accommodate any size of tap wire in a given range, whereby gradually larger sized wires can be crimped in the tap wire port as the space between the upper and lower surfaces forming the tap wire port increases in a direction toward the tap wire port entrance.

DETAILED DESCRIPTION OF THE ILLUSTRATED EMBODIMENT

The illustrated embodiments of the invention are directed to a compression connector having a single tap wire port opening for receiving a tap wire sized within a range of dimensions, the tap wire port having a contour including a plurality of nests adapted to engage tap wires of different sizes prior to and after crimping. FIGS. 1-9 illustrate a first embodiment of the compression connector, FIGS. 10-13 illustrate a modified embodiment of the compression connector, and FIGS. 14-17 illustrate a further embodiment of the compression connector.

Figure 1:
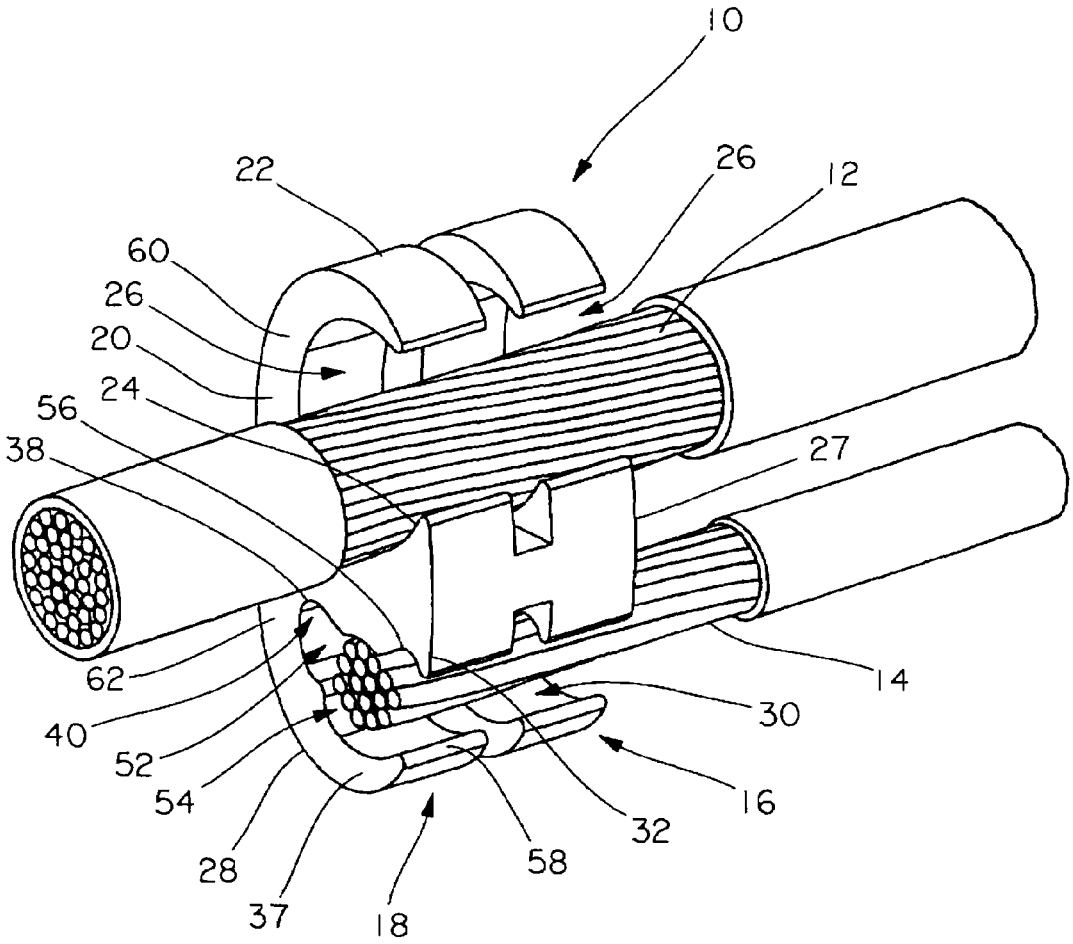
FIG. 1 is a front perspective view of a compression connector according to a first embodiment of the present invention, shown in position around a main line wire and a tap wire prior to crimping.
Figure 2:
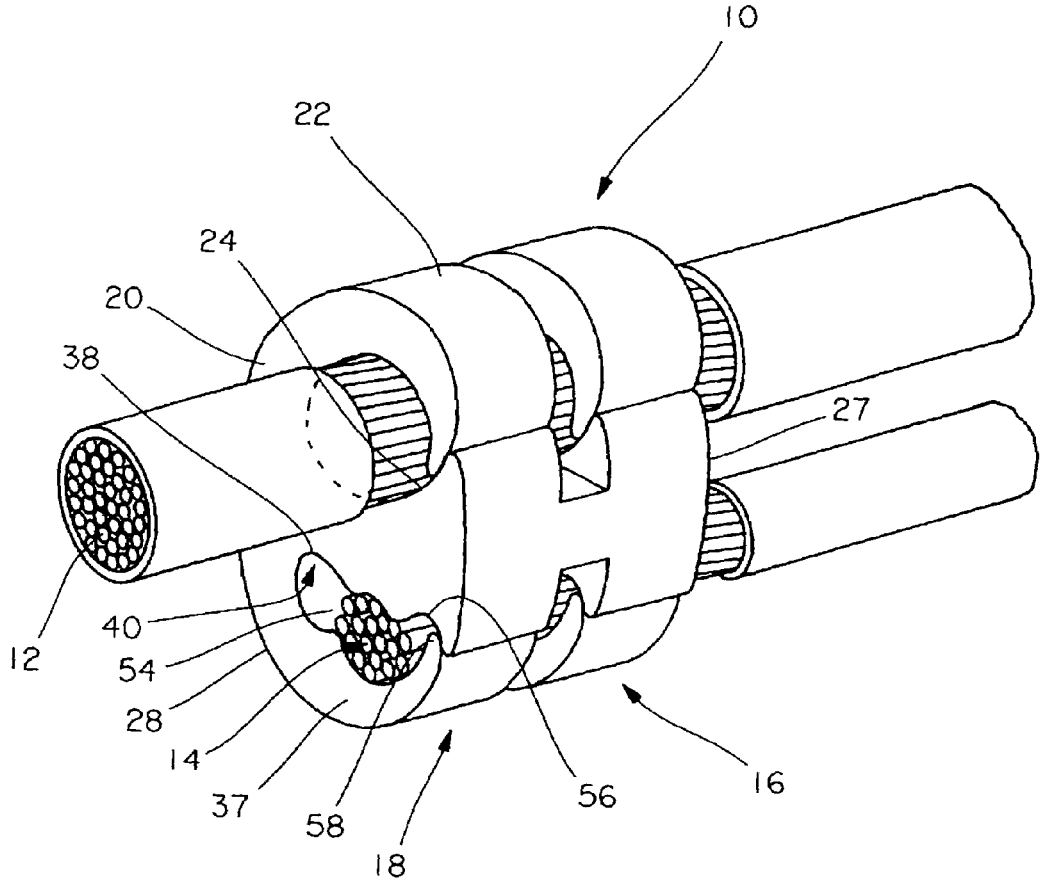
FIG. 2 is a front perspective view of the compression connector of FIG. 1, shown after being crimped around the main line wire and the tap wire.
Figure 3:
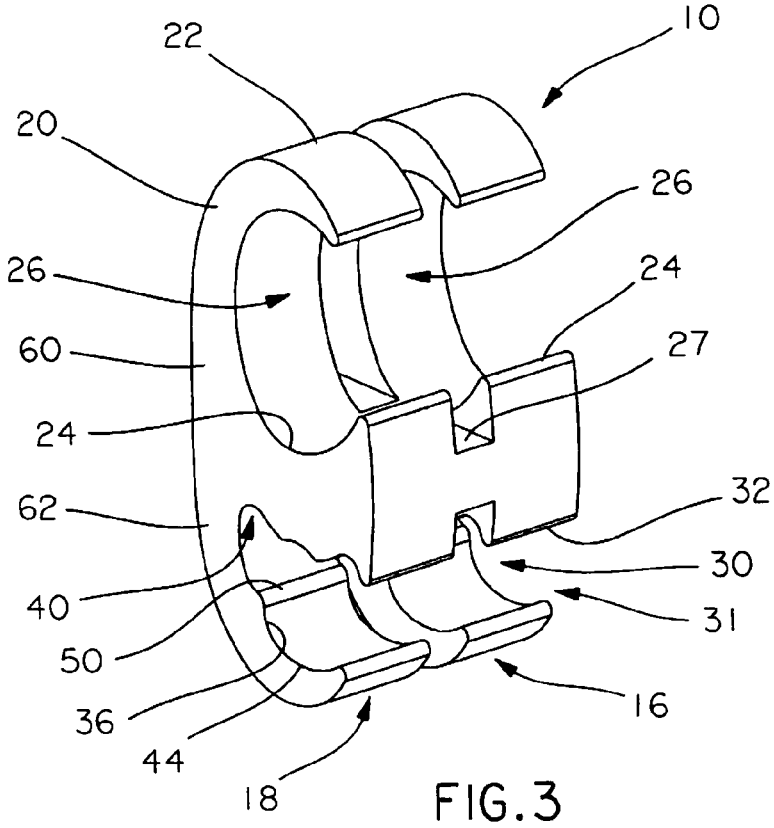
FIG. 3 is a front perspective view of the compression connector of FIG. 1.
Figure 4:
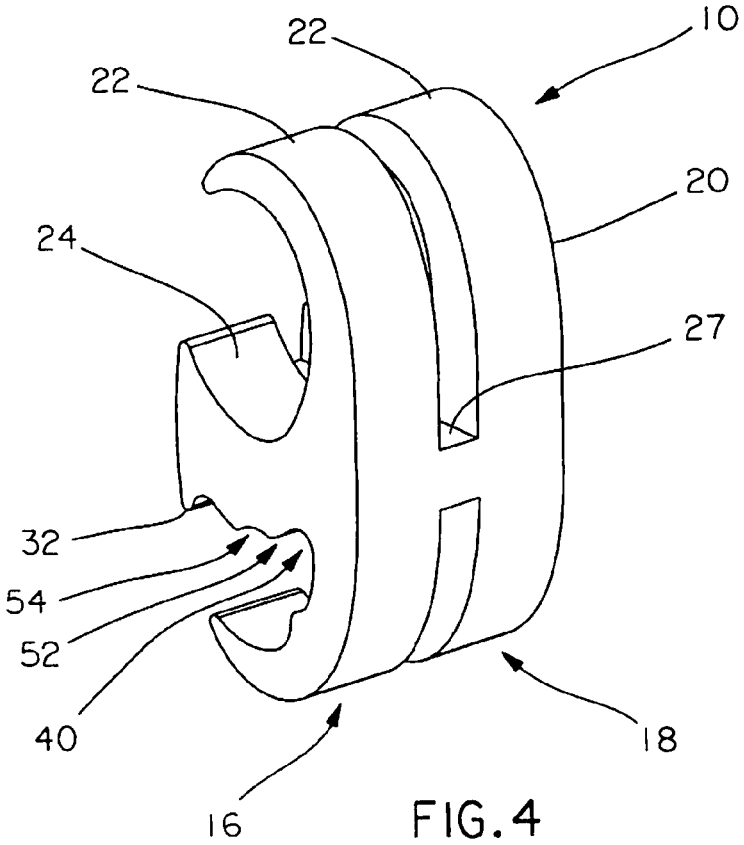
FIG. 4 is a rear perspective view of the compression connector of FIG. 1.

FIG. 1 shows a compression connector 10 prior to crimping and being secured around main line wire 12 and tap wire 14. As illustrated, compression connector 10 is a one piece member made of electrically conductive material, such as copper. However, it is likewise contemplated that compression connector 10 may be made of any suitable conductive materials or elements that will withstand a crimping operation. FIG. 2 illustrates compression connector 10 in its crimped position physically and electrically securing tap wire 14 to main line wire 12.

Figure 5:
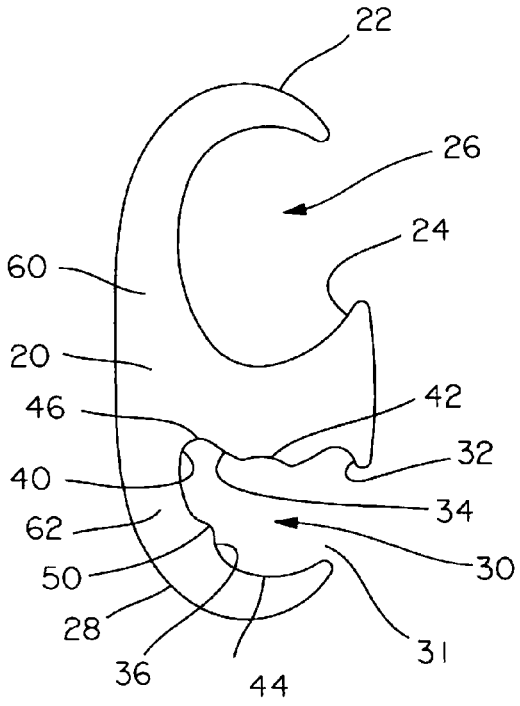
FIG. 5 is a left side view of the compression connector of FIG. 1.
Figure 6:
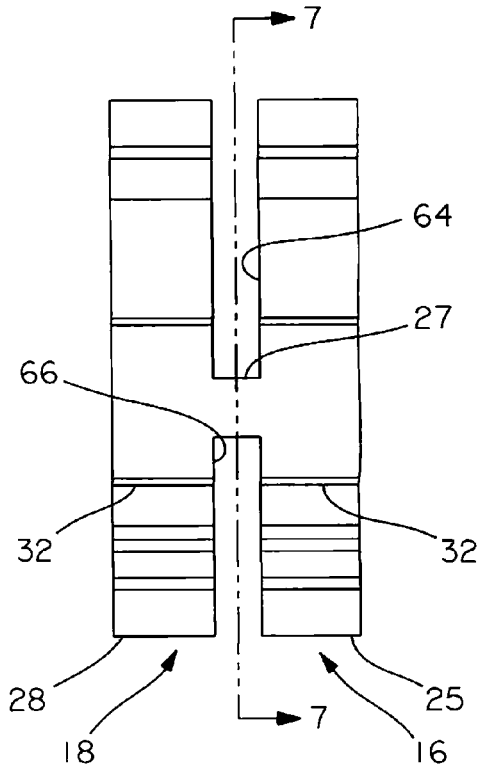
FIG. 6 is a front view of the compression connector of FIG. 1.

As shown in FIGS. 1-4, compression connector 10 comprises a first section 16 and a second section 18. As best seen in FIG. 5, first section 16 and section 18 are identical, and each section includes a first body portion 20 having a hook 22, and a ramp 24 extending from the hook to form a main wire port 26 in which main line wires 12 can be placed. First section 16 and second section 18 are connected by a central body portion 27, as seen in FIG. 6. In the illustrated embodiment, hook 22 is C shaped. First section 16 and second section 18 each have a first end wall 28 forming part of body portion 20. Tap wire port 30 is adjacent each end wall 28 and, and retention tabs 32 extend from body portion 20.

Figure 7:
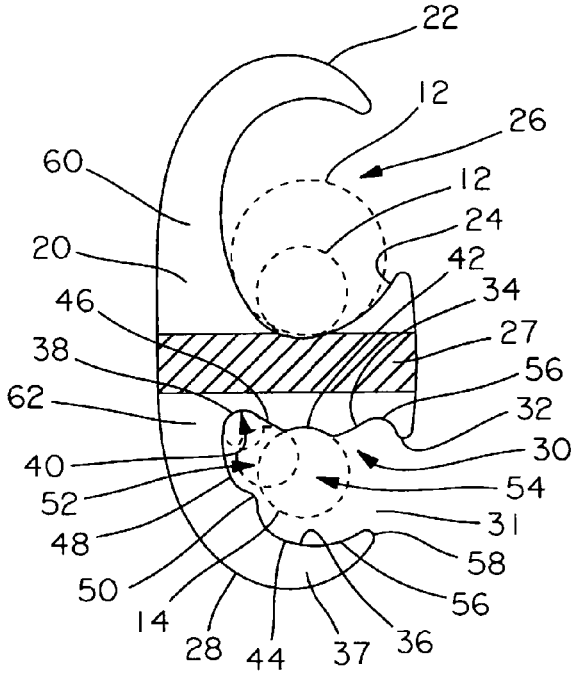
FIG. 7 is a cross-sectional view of the compression connector of FIG. 1, taken along line 7-7 of FIG. 6, and showing in phantom how a tap wire of different sizes would engage the appropriate nest of the tap wire port.

Tap wire port 30 can accommodate tap wires 14 of varying size, and provides a single entrance or opening 31 through which a tap wire 14 of any size within a given range can be readily inserted into tap wire port 30. Referring to FIGS. 5-7, tap wire port 30 is defined by an upper surface 34 and a lower surface 36. Lower surface 36 forms part of lower hook member 37. Surfaces 34 and 36 meet at a curved junction 38 opposite entrance 31 to form a first nest 40 to receive and accommodate a small diameter tap wire 14, as will be explained. Upper surface 34 also comprises a second curved portion 42, and the lower surface 36 also comprises a second curved portion 44. A portion 46 of upper surface 34 extends between nest 40 and second curved portion 42, and a portion 48 of lower surface 36 extends between nest 40 and raised portion 50 on surface 36. The space in tap wire port 30 between portion 46 of upper surface 34 and portion 48 of lower surface 36 defines a second nest 52 for accommodating a tap wire 14 in a certain range of sizes larger than the tap wires that are accommodated in first nest 40. In like fashion, second curved portion 42 of upper surface 34 and second curved portion 44 of lower surface 36 combine to form a third nest 54 for receiving and accommodating a tap wire having a diameter too large to be received in first nest 40 or second nest 52.

The upper surface 34 of tap wire port 30 also comprises a curved portion 56 ending at retention tab 32. Lower surface 36 of tap wire port 30 includes a curved portion 56 leading to the tip 58 of body portion 20. Curved portion 56 is configured to receive tip 58 upon crimping, as will be explained. It is apparent in FIG. 7 that the space between retention tab 32 and tip 58 defines the single entrance or opening 31 into tap wire port 30. Body portion 20 also includes hinge-like portions 60 and 62 to provide bending of hook 22 and lower hook member, respectively.

As best seen in FIG. 6, compression connector 10 includes two slots. 64, 66 extending between the first section 16 and the second section 18. Slots 64, 66 provide a space to loop a cable tie (not shown) to secure main line wire 12 and tap wire 14 to compression connector 10 before crimping, as disclosed in commonly assigned U.S. Pat. No. 6,818,830, the disclosure of which is incorporated by reference in its entirety. Although FIGS. 1-17 show compression connector 10 having slots 64, 66, it is similarly contemplated that compression connector 10 may not have any slots.

Figure 13:
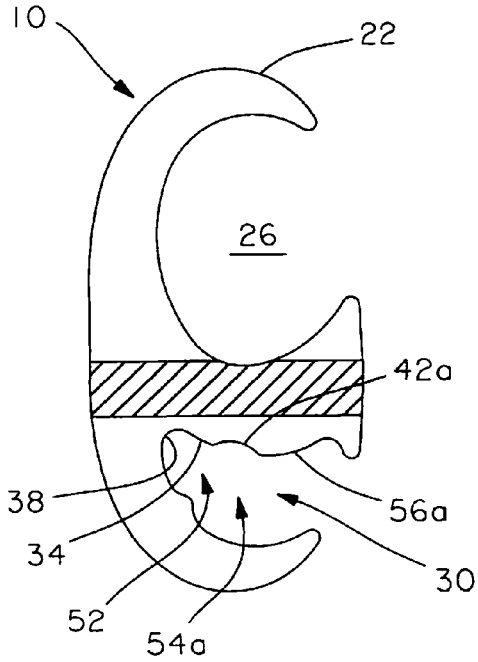
FIG. 13 is a section view of the compression connector of FIG. 10, taken along line 13-13 of FIG. 12.
Figure 14:
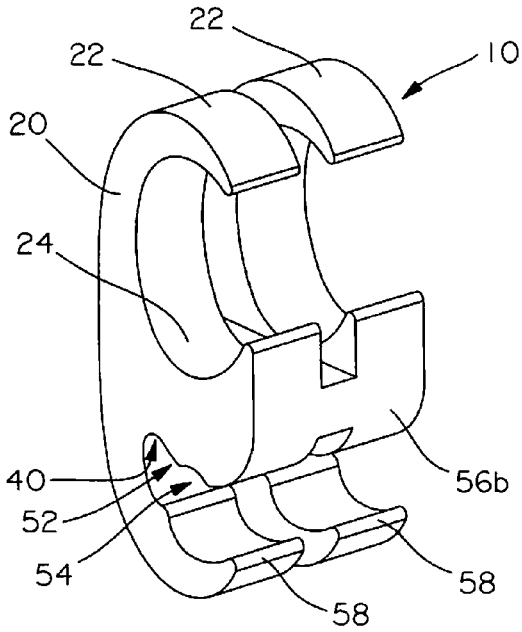
FIG. 14 is a front perspective view of a compression connector according to a third embodiment of the present invention.
Figure 15:
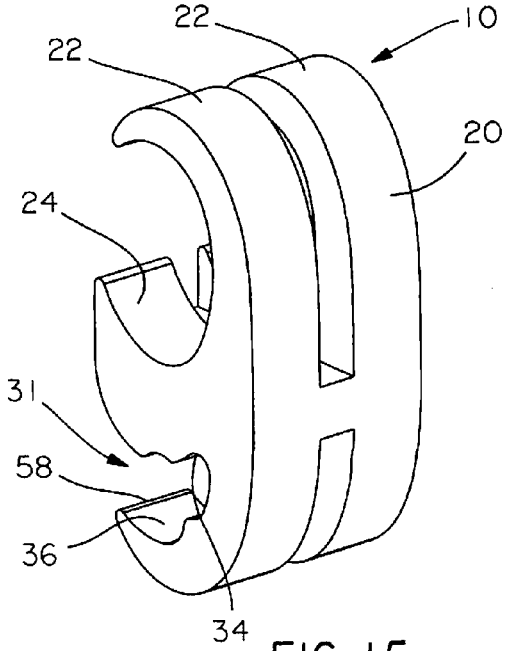
FIG. 15 is a rear perspective view of the compression connector of FIG. 14.
Figure 16:
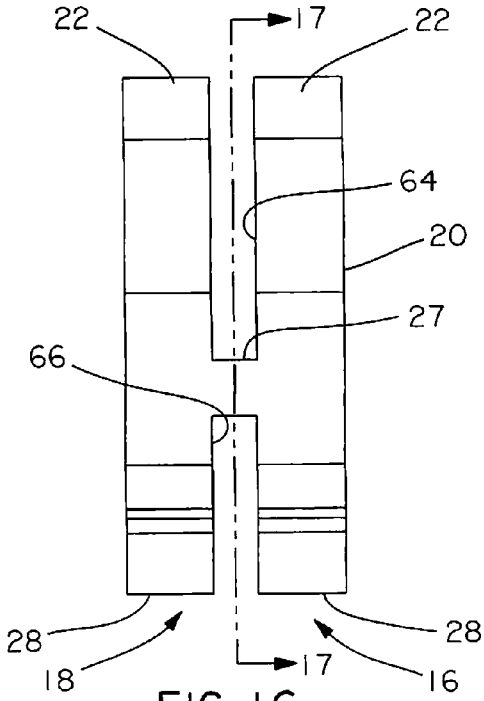
FIG. 16 is a front view of the compression connector of FIG. 14.

A second embodiment of the present invention is illustrated in FIGS. 10-13. This embodiment is similar to the embodiment of FIGS. 1-9 and like elements are identified with like numerals. However in the embodiment of FIGS. 10-13, the size of second curved portion 42*a* of upper surface 34 in FIG. 13 is smaller than second curved portion 42 in FIG. 7. Likewise, curved portion 56*a* of upper surface 34 in FIG. 13 is longer than curved portion 56 in FIG. 7. The differences between these two embodiments illustrate how the configuration of tap wire port 30 can be modified to allow the tap wire port to receive and accommodate tap wires in various size ranges. For example, the compression connector 10 shown in FIGS. 1-9 could be used to connect tap wires in the range of #6 to I/O, while the compression connector 10 of FIGS. 10-13 could accommodate tap wires in the range of #6 to #2. The configurations of first nest 40, second nest 52, and third nests 54, 54*a* (FIGS. 7, 13) determine the range of tap wire sizes that can be accommodated by compression connector 10.

Figure 17:
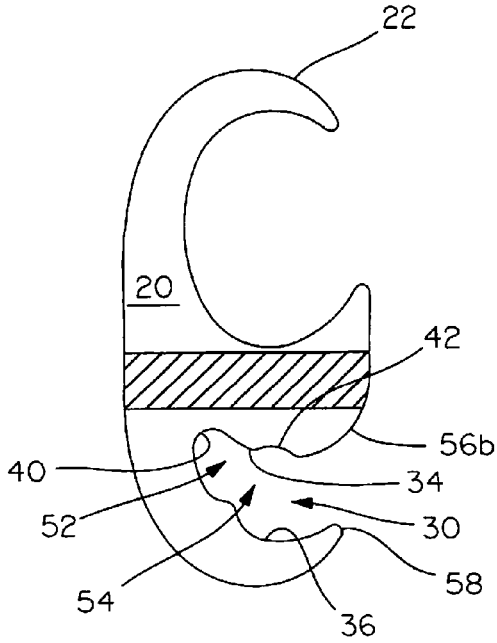
FIG. 17 is a section view of the compression connector of FIG. 14, taken along line 17-17 of FIG. 16.

A third embodiment of the present invention is illustrated in FIGS. 14-17, where like elements are identified with like numerals. This embodiment of the compression connector 10 is similar to that disclosed in FIGS. 1-9, with the exception that retention tab 32 is deleted at the entrance 31 to tap wire port 30. In this embodiment, curved portion 56*b* of upper surface 34 is directed upward and away from second curved portion 42, as seen in FIG. 17. In all other respects, the structure of the embodiment of FIGS. 14-17 is the same as the embodiment of FIGS. 1-9.

In operation, referring to the embodiment of FIGS. 1-9, C-shaped compression connector 10 allows partial hands free installation since hook 22 can be hung around main line wire 12 while tap wire 14 of varying sizes is inserted through single opening or entrance 31 into tap wire port 30. If tap wire 14 is one of the smaller sizes in the size range for which compression connector 10 is configured to accept, tap wire 14 will lodge in first nest 40 defined by curved junction 38. Likewise, if tap wire 14 is a mid-range size, the tap wire will lodge in second nest 52 defined by portion 46 of upper surface 34 and by portion 48 of lower surface 36 of tap wire port 30. If tap wire 14 is a larger sized wire, the tap wire will lodge in third nest 54 defined by second curved portion 42 of upper surface 34 and by second curved portion 44 of lower surface 36 of tap wire port 30.

As is evident, any size tap wire 14 within the range of wire sizes with which compression connector 10 is configured to function is installed in tap wire port 30 through the single entrance 31. No additional entrances or openings are necessary in body portion 20 to accommodate tap wires of varying dimensions, thus maintaining the integrity and strength of the body portion 20 for its crimping function, as will be explained. Tap wire 14 is moved into tap port 30 until it can move in no further. At this point, the tap wire is lodged in its appropriate nest 40, 52 or 54.

Figure 8:
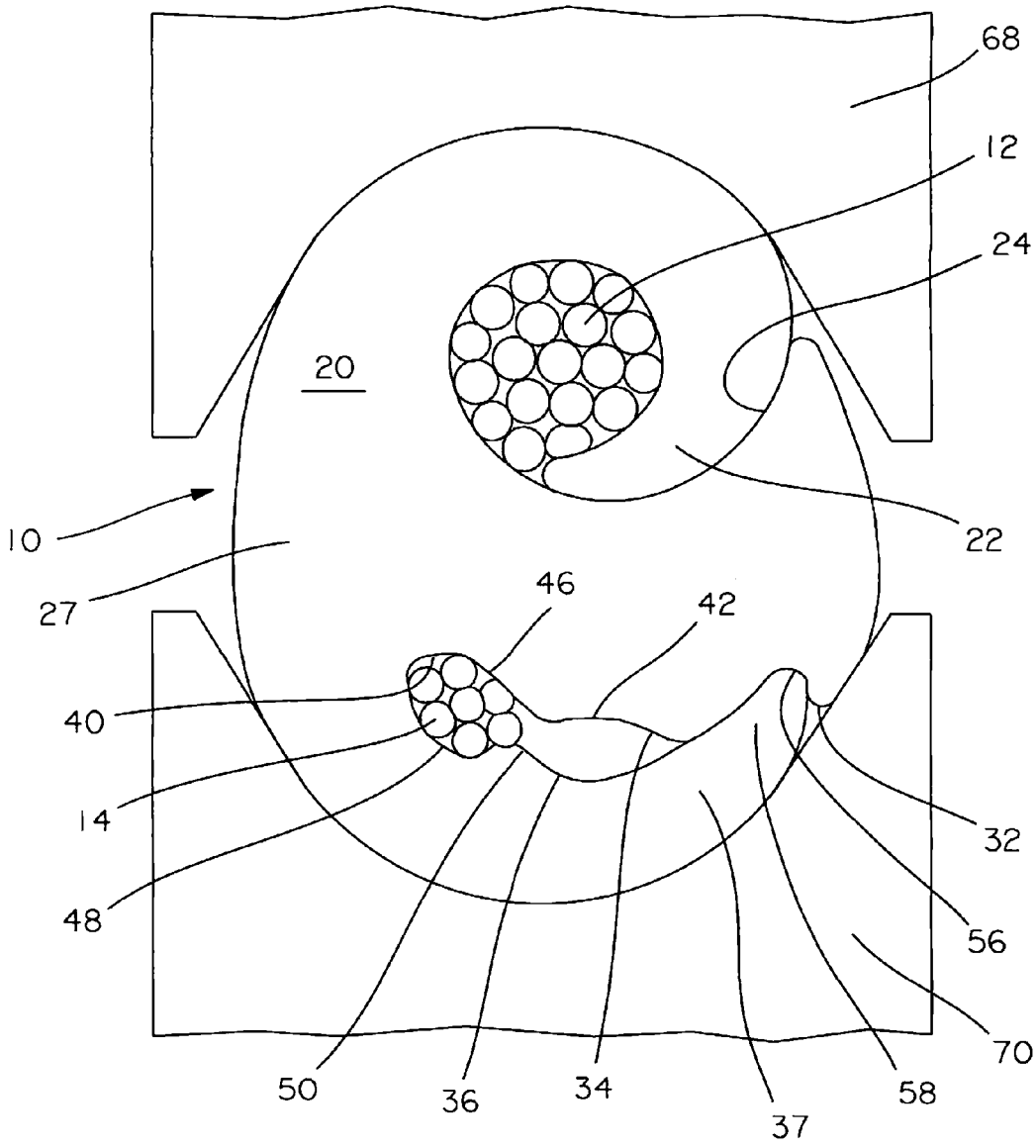
FIG. 8 is a schematic side view of the compression connector of FIG. 1 after crimping by a pair of symmetrical crimping jaws, and illustrating the connection of a tap wire at the smaller end of the range of tap wire sizes with which the present invention is used.
Figure 9:
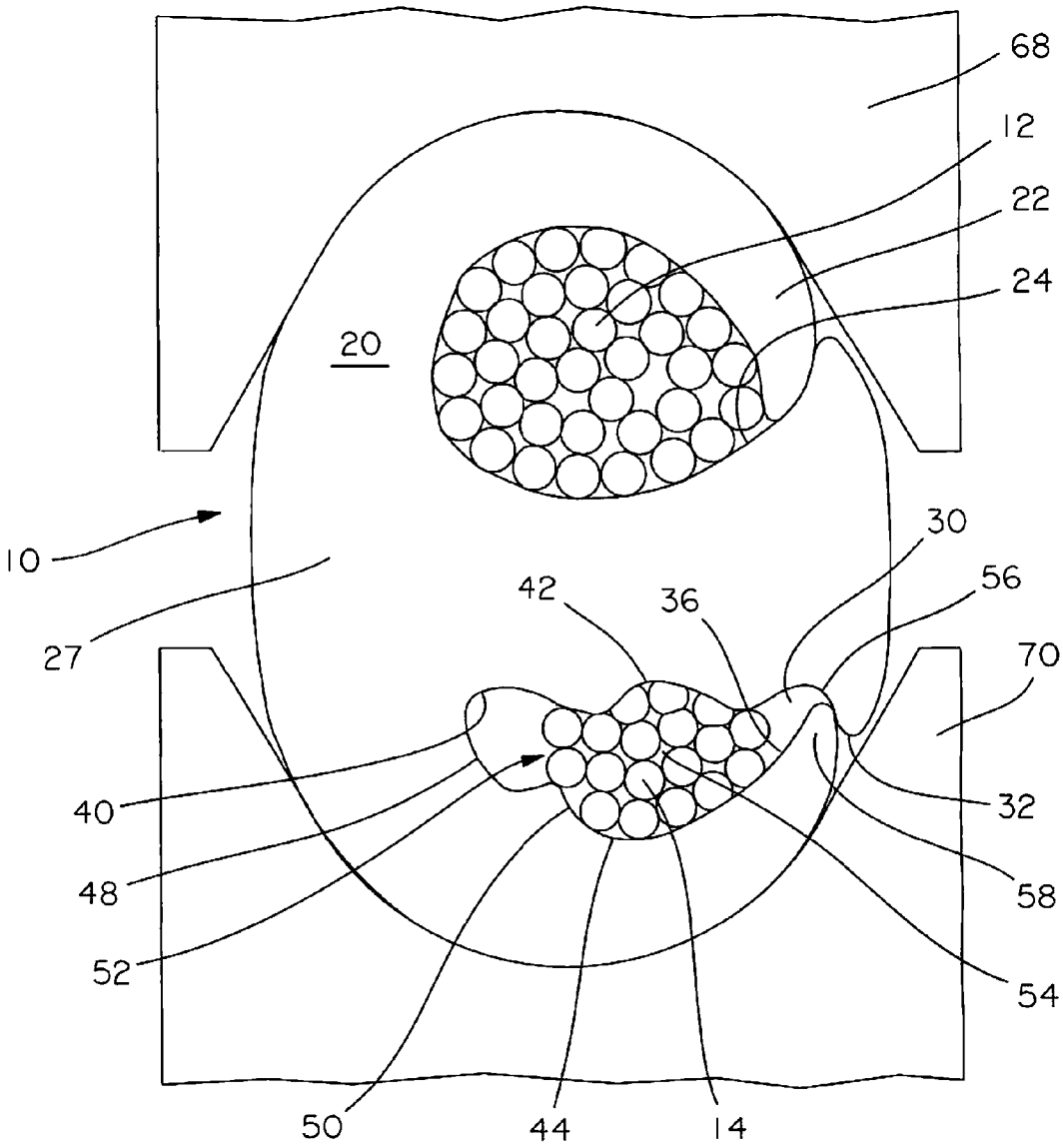
FIG. 9 is a schematic side view of the compression connector of FIG. 1 after crimping by a pair of symmetrical crimping jaws, and illustrating the connection of a tap wire at the larger end of the range of tap wire sizes with which the present invention is used.
Figure 10:
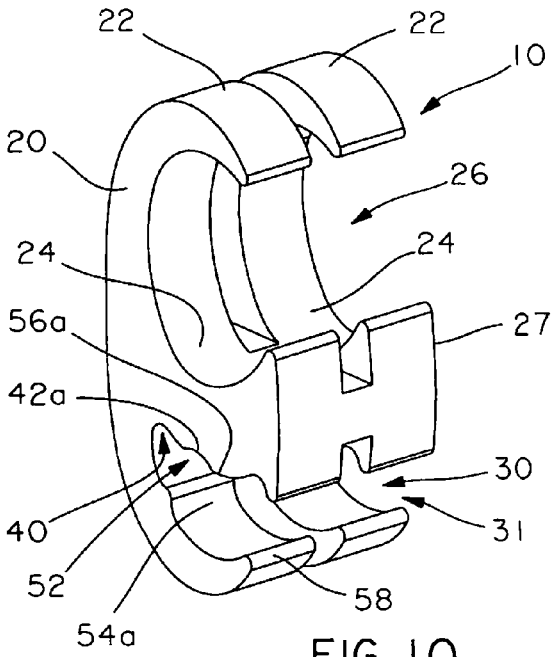
FIG. 10 is a front perspective view of a compression connector according to a second embodiment of the present invention.
Figure 11:
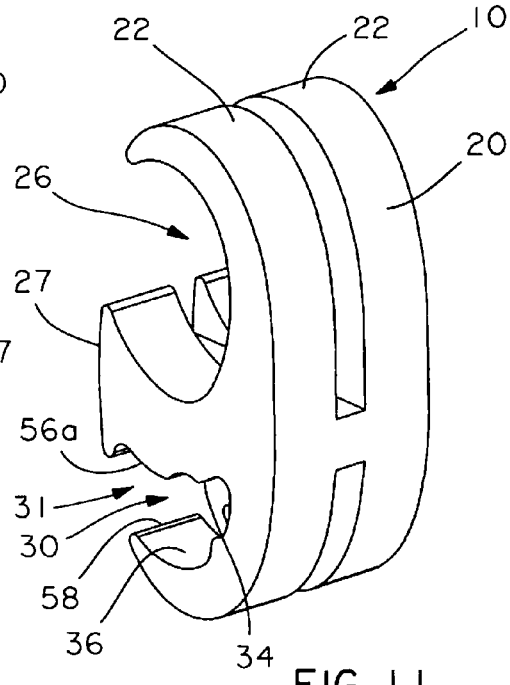
FIG. 11 is a rear perspective view of the compression connector of FIG. 10.
Figure 12:
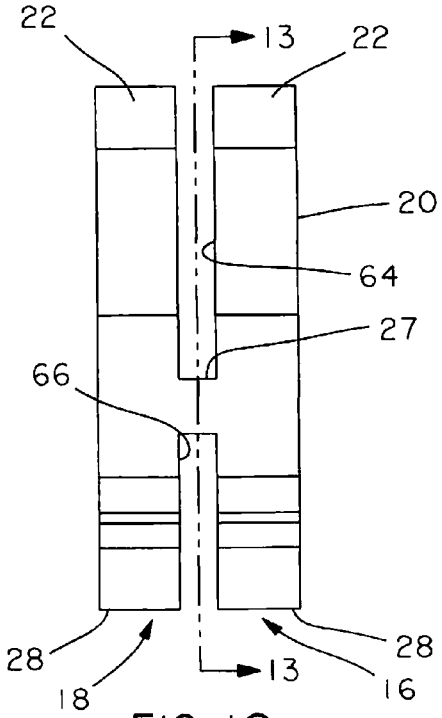
FIG. 12 is a front view of the compression connector of FIG. 10.

After the tap wire 14 has been lodged in appropriate nest 40, 52 or 54, and with main line wire 12 in place in main wire port 26, as illustrated in FIGS. 1 and 7, compression connector 10 is crimped around wires 12 and 14 using a crimping tool (not shown), such as Panduit® CT-2940 crimp tool, fitted with a pair of crimp dies 68, 70, as illustrated in FIGS. 8 and 9, such as Panduit® CD-940H-1-250 crimp dies. The outer radius of hook 22 and of first end wall 28 are smaller than the inner radius of crimping dies 68 and 70, and, thus, two die contact points are created.

During crimping, as best seen in FIGS. 8 and 9, hook 22 and ramp 24 tightly encircle main line wire 12, resulting in a connection having excellent electrical and mechanical performance. FIG. 8 illustrates the location of a smaller range tap wire 14 lodged in nest 40 of tap wire port 30 after the tap wire has been crimped tightly between portion 46 of upper surface 34 and portion 48 of lower surface 36. Tip 58 of body portion 20 is crimped inside of curved portion 56 of body portion 20, and tip portion 58 is partially held in place by retention tab 32.

FIG. 9 discloses the compression connector 10, after crimping, with a larger sized tap wire 14, compared to FIG. 8, electrically and physically connected to main line wire 12. Tap wire 14 was too large to lodge in nest 40 or nest 52, and prior to crimping became lodged in nest 54. Upon crimping, tap wire 14 in FIG. 9 is crimped tightly between second curved portion 42 of upper surface 34 and second curved portion 44 of lower surface 36 of tap wire port 30. Tip 58 of body portion 20 is partially held in place in curved portion 56 by retention tab 32.

Were tap wire 14 sized between the dimensions of tap wires shown in FIGS. 8 and 9, that tap wire, subsequent to crimping would be tightly crimped in second nest 52 (FIG. 7) between portion 46 of upper surface 34 and portion 48 of lower surface 36 of tap wire port 30.

The compression connector embodiment shown in FIGS. 10-13, as stated previously, is identical to the embodiment shown in FIGS. 1-9, with the exception that third nest 54*a* in FIG. 13 is smaller than second nest 54 in FIG. 7, and curved portion 56*a* in FIG. 13 is configured differently than curved portion 56 in FIG. 7. The embodiment of FIGS. 10-13 shows that where different ranges of tap wire sizes are to be electrically and physically attached to a main line wire, the configuration of the several nests in tap wire port 30 can be modified to accept the largest to the smallest sized tap wire in the selected range. The crimping operation of the compression connector embodiment of FIGS. 10-13 is the same as described above regarding FIGS. 1-9.

The embodiment of the invention shown in FIGS. 14-17 is also substantially similar to the compression connector 10 illustrated in FIGS. 1-9, with the exception that retention tab 32 (FIG. 7) is removed from this embodiment. When the embodiment of FIG. 17 is crimped, tip 58 abuts curved surface 56*b*, crimping tap wire 14 between upper surface 34 and lower surface 36 of tap wire port 30. Due to the inherent capability of copper to remain in the crimped position without any meaningful spring-back, lower surface 36 of tap wire port 30 remains tightly engaged against any tap wire placed in tap wire port 30 through the single entrance 31.

The disclosed invention provides a compression connector having the ability to receive and accommodate different sized tap wires within a specified range of wire sizes in a tap wire port having a single opening. The single opening provides a compression connector that is easy to manufacture and is stronger than compression connectors having multiple tap wire ports of varying sizes formed in the compression connector body. It should be noted that the above-described illustrated embodiments of the invention are not an exhaustive listing of the form such a compression connector in accordance with the invention might take; rather, they serve as exemplary and illustrative of embodiments of the invention as presently understood. By way of example, and without limitation, a compression connector having nests of varying configuration in the single tap wire port is contemplated to be within the scope of the invention.

The invention claimed is:

1. A compression connector for securing wires therein, the compression connector comprising:

a. a body portion having a first hook and a first ramp extending from said body portion forming a first opening defining an entrance to a main wire port in said body portion;

b. the body portion further having a second hook and a second ramp extending from said body portion to form a second opening defining an entrance to a tap wire port in said body portion;

c. the body portion having a plurality of nest portions in the tap wire port, each nest portion communicating with the second opening, each nest portion adapted to receive a tap wire having a size within a predetermined range of sizes.

2. The compression connector of claim 1, wherein each nest portion is configured to receive a tap wire of a different size.

3. The compression connector of claim 1 wherein said tap wire port includes an upper surface and a lower surface spaced from said upper surface, said plurality of nests each comprising a portion of said upper surface and a portion of said lower surface.

4. The compression connector of claim 3, wherein an end of said upper surface and an end of said lower surface are joined at a curved junction, said curved junction forming a first nest portion adapted to receive a tap wire in a first range of tap wire sizes.

5. The compression connector of claim 4, wherein said upper surface of said tap wire port includes a first portion and said lower surface of said tap wire port includes a first portion, said first portions forming a second nest portion adapted to receive a tap wire in a second range of tap wire sizes.

6. The compression connector of claim 5, wherein said second range of tap wire sizes is greater than said first range of tap wire sizes.

7. The compression connector of claim 5, wherein said upper surface of said tap wire port includes a second portion and said lower surface of said tap wire port includes a second portion, said second portions forming a third nest portion adapted to receive a tap wire in a third range of tap wire sizes.

8. The compression connector of claim 7, wherein said third range of tap wire sizes is larger than said second range of tap wire sizes.

9. The compression connector of claim 1, wherein said tap wire port has a retention tab extending into said second opening, and an opposed tip of the body portion extends into said second opening and is captured by said retention tab upon crimping.

10. The compression connector of claim 1, wherein said tap wire port has a curved surface formed by said body portion, and an opposed tip of the body portion extends into said second opening, said tip disposed in contact with said curved surface upon crimping.

* * * * *